US008578673B2

(12) United States Patent
Kelly et al.

(10) Patent No.: US 8,578,673 B2
(45) Date of Patent: Nov. 12, 2013

(54) SUSPENDED CEILING GUSSET STAY

(75) Inventors: Joseph J. Kelly, Spring City, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 1053 days.

(21) Appl. No.: 12/156,778

(22) Filed: Jun. 4, 2008

(65) Prior Publication Data

US 2009/0301010 A1 Dec. 10, 2009

(51) Int. Cl.
*E04B 2/00* (2006.01)

(52) U.S. Cl.
USPC ..... 52/506.06; 52/220.6; 52/506.07; 52/36.4

(58) Field of Classification Search
USPC ..... 52/506.06, 220.6, 506.07, 506.08, 52/506.05, 36.4, 36.5, 36.6; 16/94 R; 108/149, 157.13, 157.16, 157.18, 159, 108/152; 248/339, 235, 220.31, 223.41, 248/225.21, 250
See application file for complete search history.

(56) References Cited

U.S. PATENT DOCUMENTS

| | | | | |
|---|---|---|---|---|
| 4,118,903 | A * | 10/1978 | Coulthard | 160/351 |
| 5,551,792 | A * | 9/1996 | Witmyer | 403/241 |
| 5,875,596 | A * | 3/1999 | Muller | 52/239 |
| 6,711,871 | B2 * | 3/2004 | Beirise et al. | 52/782.1 |
| 7,240,460 | B2 | 7/2007 | Platt | |
| 7,278,243 | B2 | 10/2007 | Jones et al. | |
| 7,523,903 | B1 * | 4/2009 | Rindoks et al. | 248/250 |
| 2006/0010811 | A1 * | 1/2006 | Platt | 52/506.06 |

* cited by examiner

*Primary Examiner* — Branon Painter
(74) *Attorney, Agent, or Firm* — Eugene Chovanes

(57) ABSTRACT

The space above a suspended ceiling grid that extends along a corridor is kept open and free of hang wires by creating a truss at each end of a beam in the grid. The truss includes the beam itself, an opposing wall along one side of the space, and a gusset stay that extends from the wall to the beam.

5 Claims, 4 Drawing Sheets

SUSPENDED CEILING GUSSET STAY

BACKGROUND OF THE INVENTION

1. Field of the Invention

The invention involves a suspended ceiling having beams formed into a grid that supports either panels laid on, or drywall sheets attached to, the grid. Hang wires support the grid from a structural ceiling.

2. Description of Related Art

In U.S. Pat. Nos. 7,240,460, and 7,278,243, both of which are incorporated herein by reference, there is disclosed a suspended ceiling that can extend for up to about eight feet between walls, in building corridors for instance, without the need for hang wires. Such a ceiling keeps the space between the suspended ceiling and the structural ceiling open for air conditioning ducts, electrical conduits, sprinkler pipes, and other building components, that may extend along the corridor. A beam in such a ceiling extends between opposing walls, and is supported at its ends on the ledges of wall moldings.

The suspended ceiling described above sometimes extends beyond eight feet between walls for on up to generally a maximum of twelve feet.

In such extended suspended ceilings, hang wires are needed to keep the extended suspended ceiling from sagging in the middle of the span between walls. The hang wires, as used in the prior art, are embedded at their upper ends in the structural ceiling and are connected at their lower ends to the beams. Such hang wires obstruct the space between the suspended ceiling and the structural ceiling.

BRIEF SUMMARY OF THE INVENTION

In a suspended ceiling that extends between opposing sidewalls spaced apart at a distance between about eight feet to a maximum of about 12 feet, and is supported on wall moldings, gusset stays are used to provide additional support to the beams, eliminating the need for hang wires, so that the space between the suspended ceiling and the structural ceiling is kept open for building components. The invention involves the use of such gusset stays to form a truss that supports the ceiling at each end of the beams that extend between the opposing sidewalls.

The gusset stays are secured at their upper end to a horizontally extending support track attached to the wall, above the wall molding disclosed in the '460 and '243 patents. The gusset stays extend diagonally downward, in a vertical plane, from the support track to the ceiling grid, and are attached to a beam in the grid that extends between opposing walls.

By placing the support track about two feet above the wall molding so that a stay attached to the track can be attached to a beam about two feet from its end, the span of beam between walls can be increased to a distance of about 12 feet, with the space above the suspended ceiling continuing to remain clear of the hang wires that would have been necessary in the prior art.

The support track is desirably attached to studs that support the wall. The gusset stays can be attached anywhere along the track, in registry with the cross beams. The load from the stays is distributed along the support track to the wall studs to which the support track is attached.

DETAILED DESCRIPTION OF THE INVENTION

Figure 1:
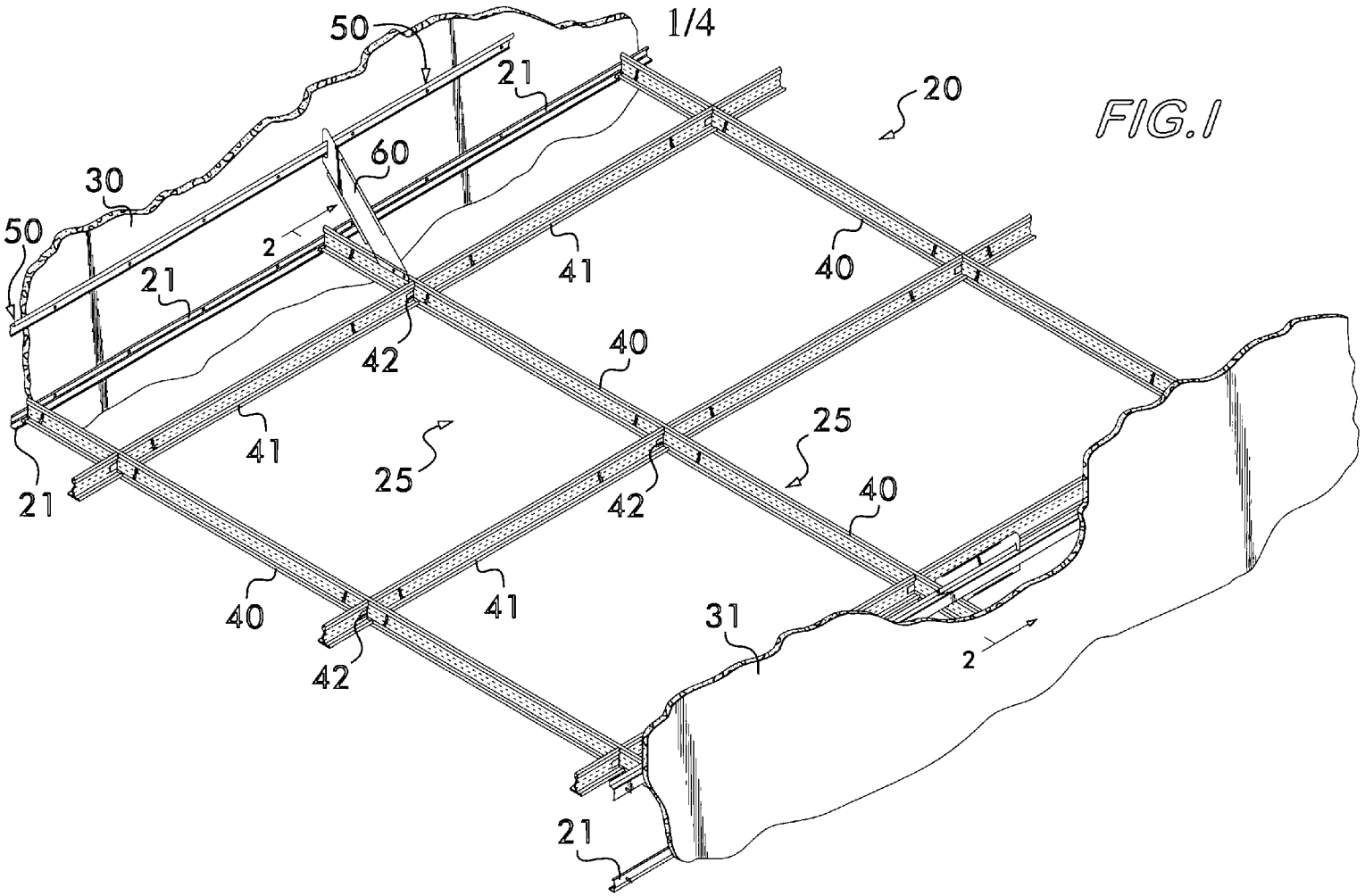
FIG. 1 is a partial perspective view, taken from above, of the suspended ceiling of the invention.
Figure 2:
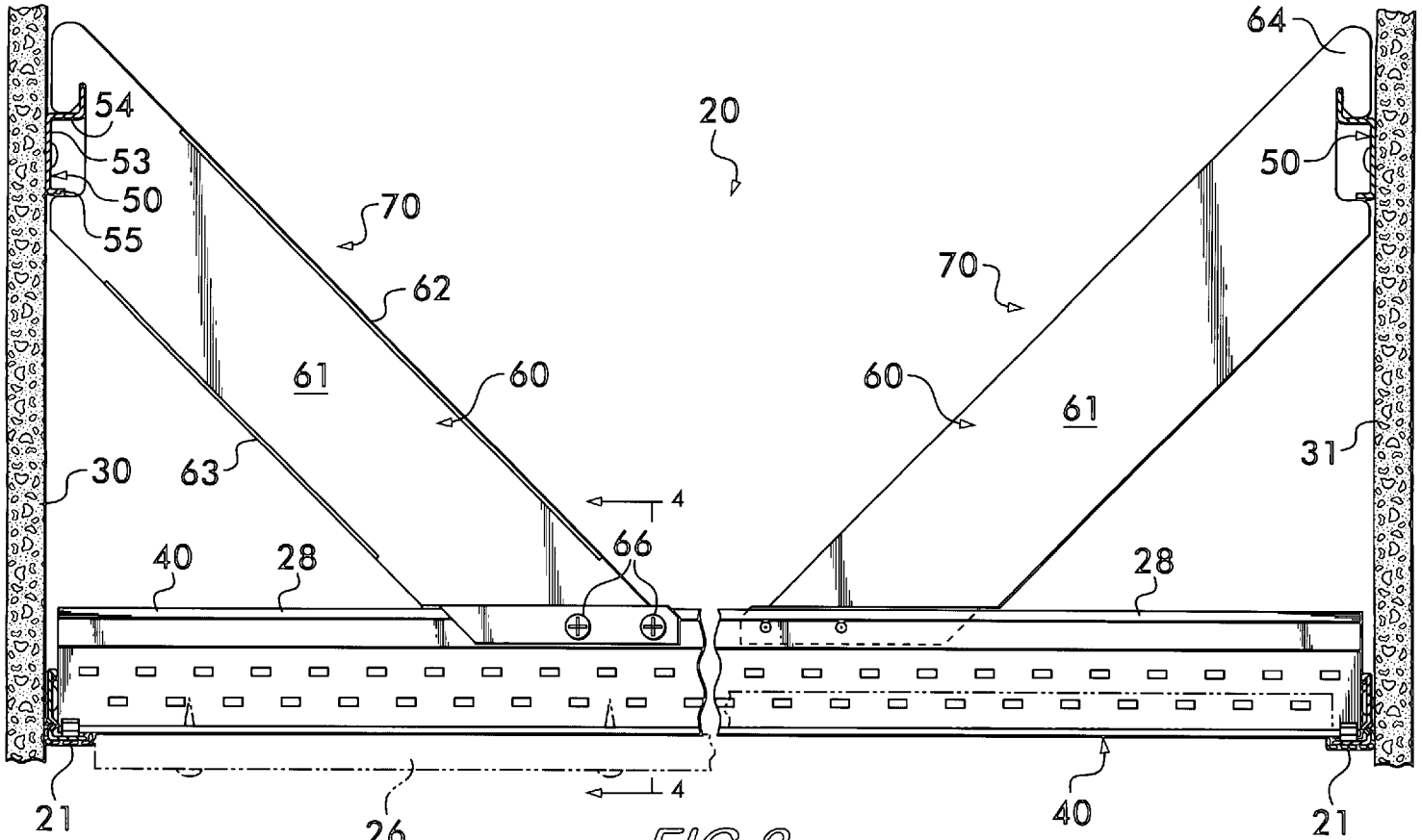
FIG. 2 is a vertical cross sectional view of the ceiling of the invention, taken on the line 2-2 of FIG. 1, with part of the ceiling between gusset stays broken away.

A suspended ceiling 20, as seen in FIG. 1, extends between opposing walls 30,31, below a structural ceiling, creating a space between the suspended ceiling 20 and the structural ceiling. Such space is open and free of supporting hang wires, and is available for air conditioning ducts, power lines, and other building components. The invention is particularly suited for installation in a corridor of a building, where the span between walls 30,31 is generally from about eight feet, up to about twelve feet.

Beams 40 in the grid 25, each of which spans the distance between opposing walls 30,31, engage tabs 22 in a horizontal ledge 23 of the wall molding 21, which is attached to an opposing wall 30,31, by fasteners 27. Beams 41 extend between, and are connected to, beams 40 in grid 25. A connection 42 between beam 41 and 40 may be of a stab-in type as disclosed, for instance, in U.S. Pat. No. 6,178,712, incorporated herein by reference, wherein a connector on beam 41 is inserted into a slot in beam 40.

The wall moldings 21, are alone adequate to support the suspended ceiling 20 for spans between opposing walls 30,31 of up to about eight feet, as disclosed in the '460 and '243 patents.

The present invention is desirably used in suspended ceilings 20 that extend between opposing walls 30,31 beyond from about eight feet on up to about twelve feet, to eliminate a need for hang wires to further support such length of beams.

The invention, as seen in the drawings, uses a support track 50 that is secured to each of the opposing walls 30,31 by fasteners 51 that desirably extend into vertical wall studs 52 that support the wall 30,31. The support track 50 extends horizontally along the wall, about two feet above the wall molding 21.

Diagonally extending gusset stays 60 are secured to the support track 50. A gusset stay 60, secured at the upper end to the support track 50, extends diagonally downward, suitably at a 45° angle from the horizontal, and is attached to a beam 40 of the ceiling grid 25, that extends between wall 30,31 at the lower end of the gusset stay 60.

Figure 3:
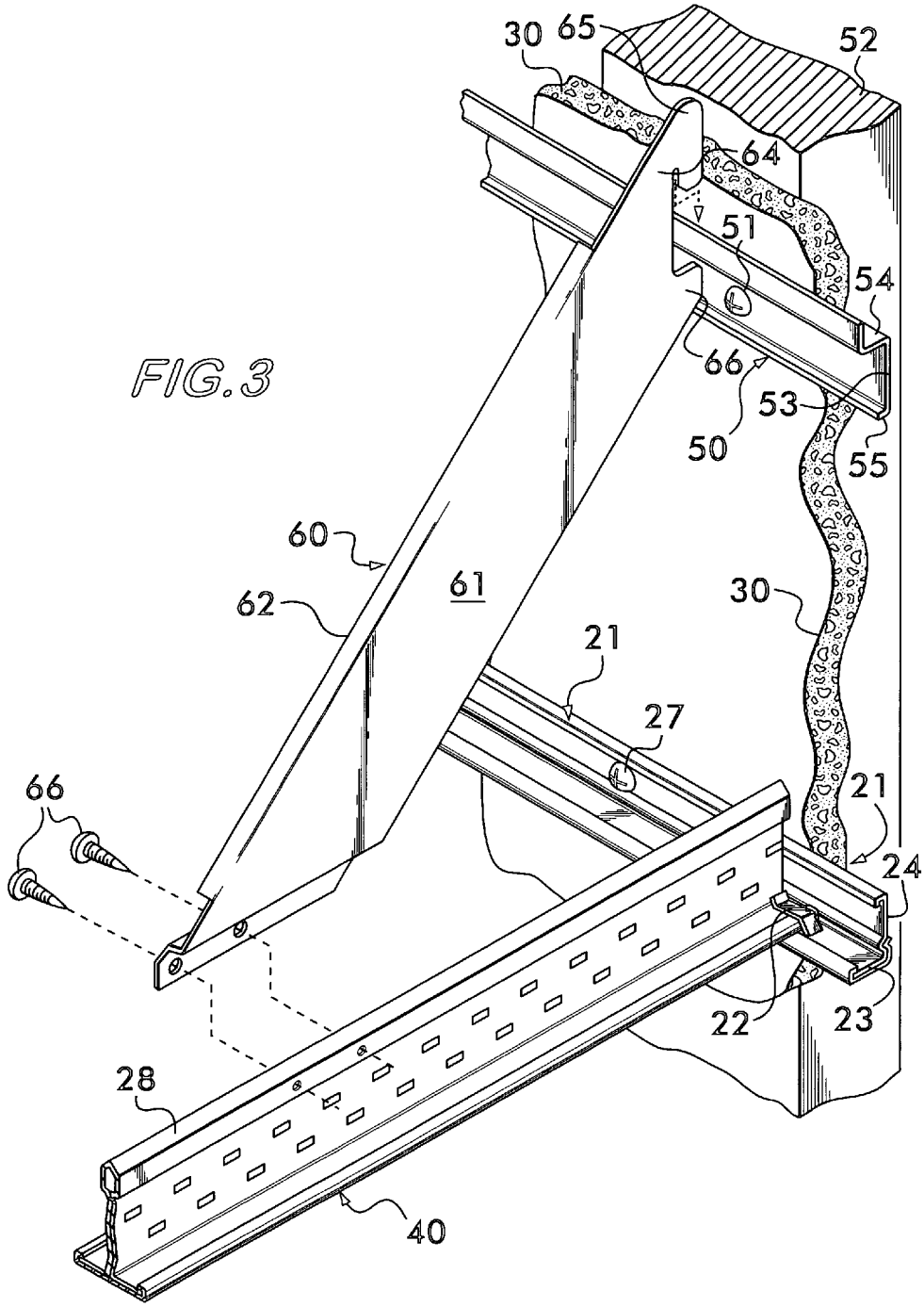
FIG. 3 is a perspective view, taken from above, of a gusset stay about to be secured to a support track, and to a beam, in the suspended ceiling of the invention.
Figure 4:
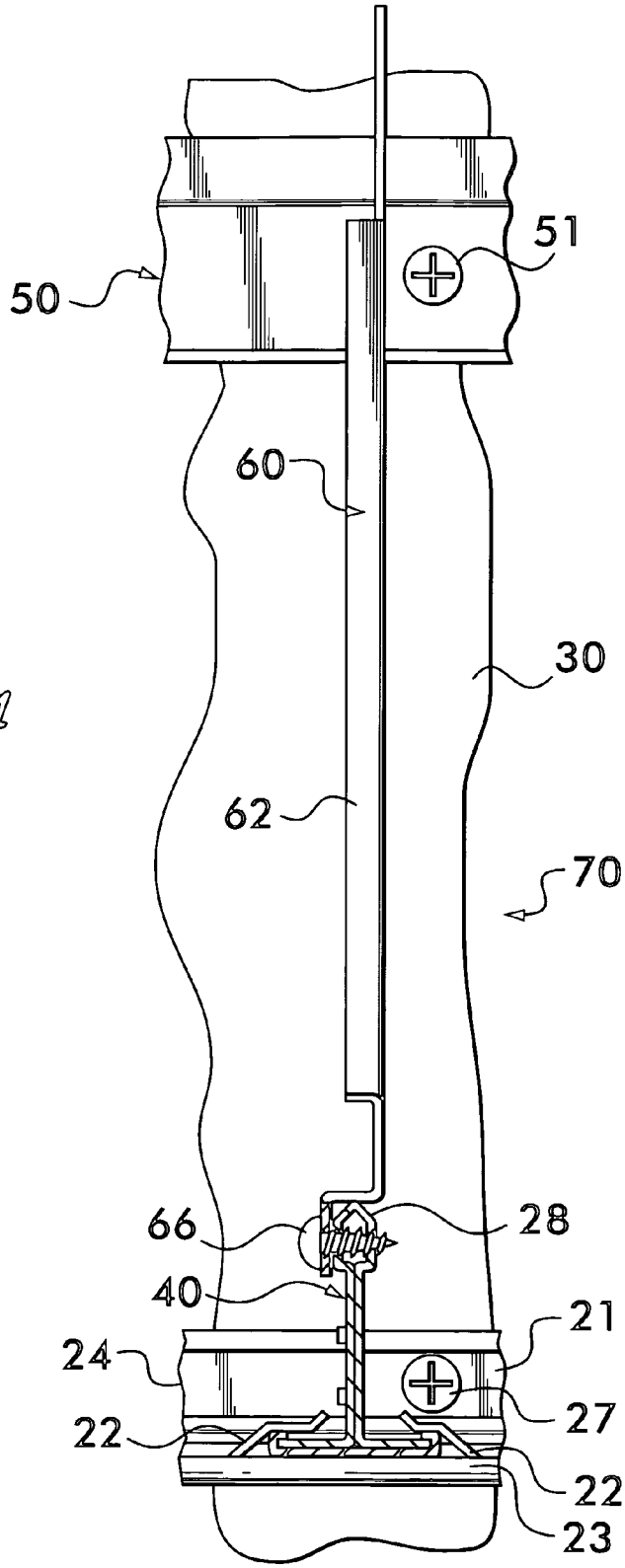
FIG. 4 is a sectional view, taken on the line 4-4 of FIG. 2.

The support track 50, as seen particularly in FIG. 3, is formed by continuously rolling a strip of sheet metal into a channel cross section having a base 53, an upper offset 54, and a lower ledge 55.

Any load placed on the support track 50 at a specific point, by a gusset stay 60 of the invention, in its support of grid 25, is distributed along the support track 50 to the various points along the wall 30,31 and to the wall studs 52.

The gusset stay 60 extends diagonally from the support track 50 to a cross beam 40. The gusset stay 60 has a channel cross section with a base 61, and arms 62 and 63.

The gusset stay 60, at its upper end, has a profile 64 that conforms to the cross section of the support track 50, so that the stay can be hooked onto the track as seen particularly in FIG. 3. A hook portion 65 engages upper offset 54, and a projection 66 fits below edge 55, of support track 50. The gusset stay 60 can slide along support track 50, into registry with a given beam 40, and then fastened, at its lower end, to the beam 40.

The profile of the gusset stay 60, at its lower end, conforms generally to the cross section of the top of beam 40, so that the gusset stay can be fitted to the beam 40 and then secured to the bulb 25 of the beam 40 with self-tapping screws, as seen particularly in FIG. 3.

The gusset stay 60, can be suitably formed by rolling or stamping from sheet metal.

The support track 50 and gusset stay 60 give support and rigidity to the beam 40, and thus to the ceiling grid 25, at a point about two feet in from each opposing wall 30,31. Such support and rigidity permits a span of up to 12 feet between walls 30,31, when used with wall moldings 21 as disclosed in the '460 and '243 patents, without the need for hang wires to support the grid 25. This allows the space above the suspended ceiling 20 to remain unobstructed.

The above described structure creates a truss 70 that supports the beam 40 inwardly from its end, thus reducing the length of an unsupported span of beam 40. The vertical leg of the truss is formed by an opposing wall 30,31, the horizontal leg of the truss is formed by a portion of the beam 40, while the gusset stay 60 forms the diagonal element of the truss 70.

What is claimed is:

1. In a grid (25) in a suspended ceiling (20) having a span between opposing parallel walls (30,31), the grid having (a) a wall molding (21) secured along each of the opposing parallel walls (30,31), and (b) inverted T-beams (40) extending between the opposing parallel walls (30,31), that are supported at their ends on the wall moldings (21), the improvement comprising (c) a span of up to about twelve feet having a support track (50) secured along each opposing parallel wall (30,31), above the wall molding (21); and (d) a gusset stay (60) at each end of a T-beam (40) that 1) is connected at its upper end to a support track (50), 2) extends diagonally downward from the support track (50), and 3) is connected at its lower end to an inverted T-beam (40) extending between the opposing walls (30,31);

wherein (1) a parallel wall, (2) a gusset stay, and (3) the end of an inverted T-beam form a truss that supports a T-beam away from the wall, whereby the span of ceiling between the parallel walls supported without hang wires from a structural ceiling, is increased.

2. The grid of claim 1 wherein (a) the support track (50) has a cross section that includes a base (53), and edges (54,55) extending from the base (53), and (b) the gusset stay (60) has an upper end with a profile that conforms to the cross section of the support track (50);

whereby the gusset stay (60) can be (a) engaged with the support track (50), and (b) slid along the support track (50) to position the gusset stay (60) in registry with a beam (40).

3. The grid of claim 2 wherein the gusset stay (60) has a shape at its lower end conforming to the top of beam (40) whereby it can be secured to a beam (40) with a self-tapping screw.

4. The grid of claim 1, wherein the opposing walls (30,31) form a corridor below the suspended ceiling (20).

5. In a suspended ceiling 20 having a grid (25) with beams (40) that extend between opposing walls (30,31) up to about twelve feet apart that form a corridor below the suspended ceiling (20), a truss (70) at each end of a beam (40), having (a) a vertical leg formed by a length of opposing wall (30,31), (b) a horizontal leg formed by a segment of beam (40), and (c) a diagonal gusset stay (60) extending between, and connected to, the vertical leg by a support track extending horizontally along the length of an opposing wall, and to the horizontal leg, wherein the truss (70) creates a support at a point on the beam (40), away from an opposing wall (30,31).

* * * * *